US006845740B2

(12) United States Patent
Kohrs

(10) Patent No.: US 6,845,740 B2
(45) Date of Patent: Jan. 25, 2005

(54) INTERNAL COMBUSTION ENGINE ADJUSTING THE ROTATION ANGLE OF A CAMSHAFT WITH RESPECT TO A CRANKSHAFT

(75) Inventor: Mike Kohrs, Herzogenaurach (DE)

(73) Assignee: Ina-Schaeffler KG (DE)

( * ) Notice: Subject to any disclaimer, the term of this patent is extended or adjusted under 35 U.S.C. 154(b) by 49 days.

(21) Appl. No.: 10/319,134

(22) Filed: Dec. 13, 2002

(65) Prior Publication Data

US 2003/0116110 A1 Jun. 26, 2003

(30) Foreign Application Priority Data

Dec. 15, 2001 (DE) ..... 101 61 698

(51) Int. Cl.[7] ..... F01L 1/34

(52) U.S. Cl. ..... 123/90.17; 123/90.18; 74/568 R; 464/160

(58) Field of Search ..... 123/90.17, 90.16, 123/90.15, 90.18, 90.12, 90.31; 74/568 R; 464/1, 2, 160

(56) References Cited

U.S. PATENT DOCUMENTS 6,363,897 B2 * 4/2002 Scheidt et al. ..... 123/90.17
6,457,447 B1 * 10/2002 Sato et al. ..... 123/90.17
6,457,448 B1 * 10/2002 Dietz ..... 123/90.17
6,477,996 B2 * 11/2002 Ogawa ..... 123/90.15
6,513,473 B2 * 2/2003 Daut ..... 123/90.17
6,516,763 B1 * 2/2003 Strauss ..... 123/90.17
6,668,774 B1 * 12/2003 Dauer et al. ..... 123/90.15
2002/0050257 A1 * 5/2002 Watanabe ..... 123/90.17
2003/0037740 A1 * 2/2003 Watanabe ..... 123/90.17
2003/0037741 A1 * 2/2003 Kohrs ..... 123/90.17
2003/0051686 A1 * 3/2003 Trappe et al. ..... 123/90.17

FOREIGN PATENT DOCUMENTS

DE 19921890 8/2000
EP 0896129 2/1999

* cited by examiner

*Primary Examiner*—Cheryl J. Tyler
*Assistant Examiner*—William H. Rodriguez
(74) *Attorney, Agent, or Firm*—Ostrolenk, Faber, Gerb & Soffen, LLP

(57) ABSTRACT

A device for hydraulically adjusting the rotation angle of a camshaft with respect to a crankshaft of an internal combustion engine: A drive unit connected to a crankshaft and an output unit connected to a camshaft, having radially extending, axially facing sides secured by the pre-stressing force of a central securing bolt. The drive unit is rotably mounted to the output unit and they are so connected that at least two hydraulic pressure chambers transmit relative rotation forces. An annular disk with coating on opposite sides increases the frictional force between the end face of the output unit which faces the camshaft and the end of the camshaft and enables reduction of the pre-stressing force on the bolt. The character of visually detectable elements on the disk enable detection of the presence or absence of the disk.

11 Claims, 2 Drawing Sheets

INTERNAL COMBUSTION ENGINE ADJUSTING THE ROTATION ANGLE OF A CAMSHAFT WITH RESPECT TO A CRANKSHAFT

FIELD OF THE INVENTION

The invention relates to a device for altering the control times of gas exchange valves of an internal combustion engine which can be implemented particularly advantageously on a means for hydraulically adjusting the rotation angle of a camshaft with respect to a crankshaft, and particularly relates to eliminating prestressing force on a bolt that fastens the drive and output units on the respective shafts.

BACKGROUND OF THE INVENTION

A device of this type is already known from EP 0 896 129 A1. This device in principle is designed as a hydraulic actuating drive which can be controlled as a function of various operating parameters of the internal combustion engine. It is arranged at the drive-side end of a camshaft mounted in the cylinder head of the internal combustion engine. It substantially comprises a drive unit, which is drive-connected to a crankshaft of the internal combustion engine, and an output unit, which is connected in a rotationally fixed manner to the camshaft of the internal combustion engine. In a specific embodiment, the device is designed as what is known as a pivot-blade adjuster. The drive unit is formed by a cylindrical hollow gear which has external toothing and a plurality of hydraulic working chambers, which are separated from one another by inner radial webs. The output unit is a blade wheel which is inserted into the hollow gear. It has a plurality of blades extending radially away from its wheel hub and dividing the working chambers in the drive unit into in each case two hydraulic pressure chambers which act against one another. Furthermore, in its wheel hub, the blade wheel which is designed as an output unit has an axial through-bore. At the same time that bore is a pressure-medium passage. The side face of the blade wheel, which faces the camshaft, is fixed in a nonpositively locking manner, in the axial and peripheral directions, to the end side of the drive-side end of the camshaft by the prestressing force of a central securing bolt. That bolt is guided through this through-bore and can be screwed into an axial threaded bore in the end side of the camshaft. In addition, that side face of the blade wheel which faces the camshaft and the end side of the camshaft specifically have complementary molded elements which are a centering opening of widened diameter in the axial through-bore in the blade wheel and a centering pin of reduced diameter on the camshaft. The molded elements of the device can also be fixed to the camshaft in the radial direction by positive locking and at the same time centering occurs. The drive unit, which is a hollow gear, is mounted rotatably, via its inner radial webs, on the wheel hub of the output unit, which is a blade wheel, and the gear is connected to the output unit in a force-transmitting manner, via the pressure chambers formed inside the device. The connection is in such a manner that when a hydraulic pressure medium is applied to the pressure chambers, the output unit undergoes relative rotation or is fixed with respect to the drive unit, and therefore the camshaft is fixed with respect to the crankshaft.

However, a drawback of this known device is that the output unit of the device sometimes has to be fixed axially with a very high prestressing force of the central securing bolt to the end side of the camshaft, dependent upon the level of torques which are introduced by the drive unit and which have to be transmitted without play to the camshaft and dependent upon the associated axial and radial forces. In practice, it has been found that this high prestressing force of the securing bolt causes extremely high clamping forces to act on the output unit. This can lead to increased mechanical load and even to deformation and/or cracks in the material on the output unit. This can cause failure or reduced durability and service life of the device.

OBJECT OF THE INVENTION

The invention has the object of providing a device for altering the control times of gas exchange valves of an internal combustion engine, particularly means for hydraulically adjusting the rotation angle of a camshaft with respect to a crankshaft, to avoid the increased mechanical load on the output unit which results from a high prestressing force of the central securing bolt and the associated disadvantageous consequences for the device.

SUMMARY OF THE INVENTION

According to the invention, this object is achieved by a device generally as described above, with prestress reduction. For this purpose an annular disk, which on both of its side faces has a coating which increases the frictional force between the output unit and the camshaft, is additionally arranged between that side face of the output unit which faces the camshaft and the end side of the camshaft. The annular disk can reduce the prestressing force of the central securing bolt which is required for play-free torque transmission from the drive unit to the camshaft. The annular disk is formed with elements which can be detected mechanically or visually to check that it is present.

This type of annular disk with a coating which increases the frictional force, therefore makes it possible, and at low cost, to fix the output unit of the device to the end side of the camshaft without play in the axial and peripheral directions. It enables the same torques to be transmitted from the drive unit to the camshaft, with a considerably reduced prestressing force of the central securing bolt and without excessive mechanical loads. The output unit is fixed to the camshaft in the radial direction by known positive locking because the camshaft is designed with a centering pin of reduced diameter at its drive-side end and the output unit has a centering opening, of correspondingly widened diameter, in its axial through-bore. By this means, the output unit, together with the additional annular disk, is placed onto the centering pin on the camshaft. However, since the additional annular disk represents an indispensable component of the connection between the device and the camshaft if the internal combustion engine is to function without problems, it must be possible to detect in a suitable way that this disk has been either unintentionally omitted or that it is present. Otherwise the reduced prestressing force of the securing bolt may cause undesirable rotation of the device on the camshaft and under unfavorable circumstances, damage to the internal combustion engine.

In a first embodiment of the invention, the additional annular disk is preferably a metal disk of defined thickness which is coated on both side faces with aluminum-titanium dioxide. Its external diameter does not exceed the external diameter of the camshaft. It is inserted in the manner of a washer into the clamping joint between that side face of the output unit which faces the camshaft and the end side of the camshaft.

To check if the metal disk is present, the device is operatively connected to a stop face, which is arranged opposite its drive unit in the direction facing the camshaft, such that when the device is bolted to the camshaft by the central securing bolt, unintentional omission of the annular disk can be mechanically detected because the device becomes jammed against the stop face. This stop face is at a distance from the drive unit of the device which is less than the thickness of the metal disk. It is formed either by a further component of the internal combustion engine, which surrounds the camshaft, for example by a pressure-medium distributor for the device, or by an additional encircling camshaft shoulder. Therefore, omission of the additional annular disk inevitably eliminates the functionally important distance between the device and the opposite stop face after the device has been mounted on the camshaft, and causes recognition, without further tools, that the drive unit of the device, which is otherwise pivotably moveable, becomes unacceptably impossible to move. As an alternative to a mechanical check of this type, it is also possible for the parts which are to be mounted on the internal combustion engine after the device, for example the bearing bracket of the drive-side camshaft bearing or the cylinder-head cover, to be designed such that they cannot be fitted if the annular disk is missing.

In a second, likewise highly advantageous embodiment of the device of the invention, the additional annular disk is designed as a plastic film or metal foil which is coated on both side faces with a hard material, such as for example diamond dust or the like. It is likewise inserted in the manner of a washer into the clamping joint between that side face of the output unit which faces the camshaft and the end side of the camshaft. Since plastic films or metal foils of this type generally have a very small thickness and/or a metallic shine and therefore can only be seen with difficulty when the device is being assembled, it has proven advantageous for them to be designed with features which visually stand out with respect to adjacent components, in order to make it possible to check that they are present. Features which visually stand out of this type can particularly advantageously be realized in the form of an indicator color or reflection layer which is mixed into the coating of the annular disk and/or in the form of one or more local recesses in or on the side faces of the annular disk, through which the surface of the camshaft end side, which is covered for example during bolting together of the device, becomes visible. In this context, a combination of the above-mentioned visual features in which the plastic film or metal foil has, for example, an indicator color in its coating and a plurality of stamped-out portions distributed uniformly over the circumference of its side faces or a reflection layer in its coating and a plurality of notches on its side faces, and therefore visually stands out from the surface of the camshaft end side arranged below it, has proven most suitable. However, as an alternative to the indicator color or the reflection layer in the coating of the plastic film or metal foil, it is also possible for the surface of the camshaft end side to be marked in this way and to be made visible through local recesses in or on the annular disk or for local recesses of this type to be machined into the surface of the camshaft end side. These recesses are then covered by the annular disk. This feature indicates the presence of the annular disk. When using annular disks made from metal foil, as an additional securing means, it is also conceivable for these disks to be made magnetic, so that they automatically stick to the camshaft or to the device.

It is possible to dispense with the use of additional annular disks with a friction-increasing coating altogether and to instead mix silicon or other hard-material particles into the base material of the camshaft. These particles are etched clear in the region of the connection to the device and contribute to an increase in the friction between the device and the camshaft. Alternatively, silicon or other hard-material particles of this type can also be pressed into that side face of the output unit of the device which faces the camshaft in the region of the connection to the camshaft, since the base material of the output unit is generally softer than the base material of the camshaft.

Therefore, in both embodiments described, the device which has been designed in accordance with the invention for altering the control times of gas exchange valves of an internal combustion engine, in particular the means for hydraulically adjusting the rotation angle of a camshaft with respect to a crankshaft, has the advantage over the prior art that the insertion of an additional annular disk, which is provided with a coating which increases friction, into the clamping joint between the output unit of the device and the end side of the camshaft provides an inexpensive way of significantly reducing the prestressing force of the central securing bolt which is required for play-free torque transmission from the drive unit to the camshaft. This also avoids the increased mechanical load on the output unit, with the associated disadvantageous effects for the device, which results from the high prestressing force which has hitherto been required. Furthermore, in both embodiments, the additional annular disk includes, as an indispensable part of the connection between the device and the camshaft if subsequent damage is to be avoided, suitable elements which can be mechanically or visually detected and by means of which unintentional omission or the presence of the annular disk can be reliably checked during or after mounting of the device on the camshaft. However, the range of possible applications for annular disks of this type is not restricted just to the connection between a camshaft adjustment device and a camshaft, but rather can also be extended to general axial clamping connections between a shaft or hub and a component which is to be flanged on, for example sprockets, pulleys or gearwheels.

Other features and advantages of the present invention will become apparent from the following description of the invention which refers to the accompanying drawings.

BRIEF DESCRIPTION OF THE DRAWINGS

The invention is explained in more detail below with reference to two exemplary embodiments and diagrammatically depicted in the appended drawings, in which.

DETAILED DESCRIPTION OF PREFERRED EMBODIMENTS OF THE INVENTION

Figure 1:
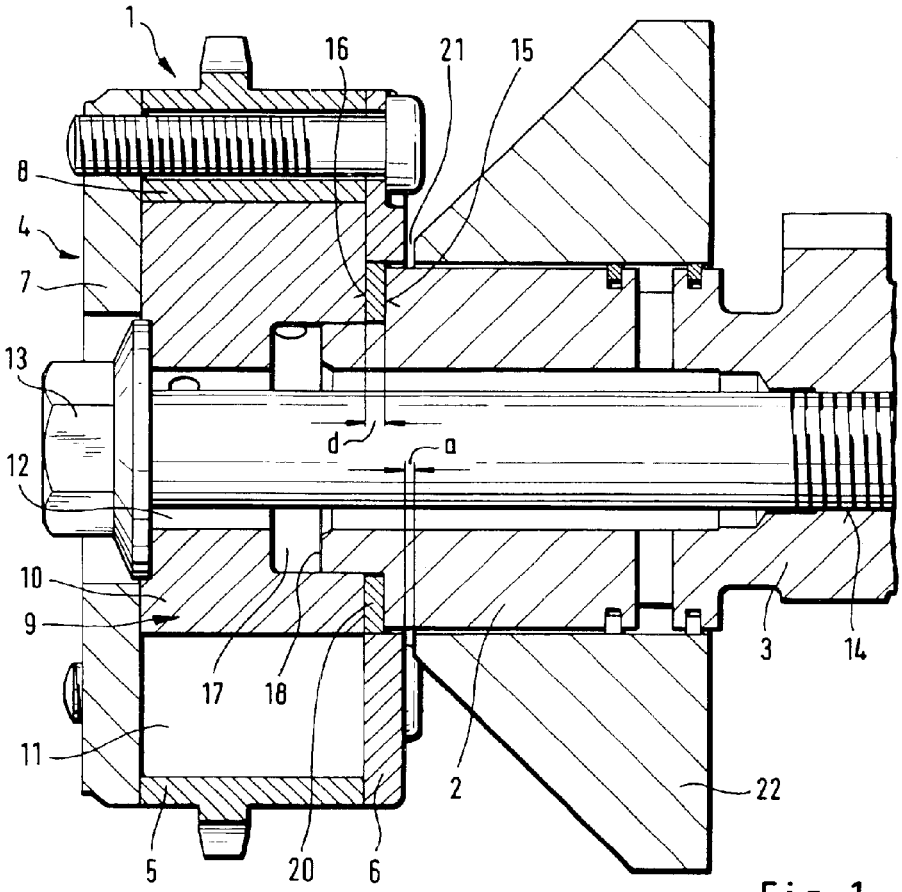
FIG. 1 shows a longitudinal section through a first embodiment of a device designed in accordance with the invention.
Figure 3:
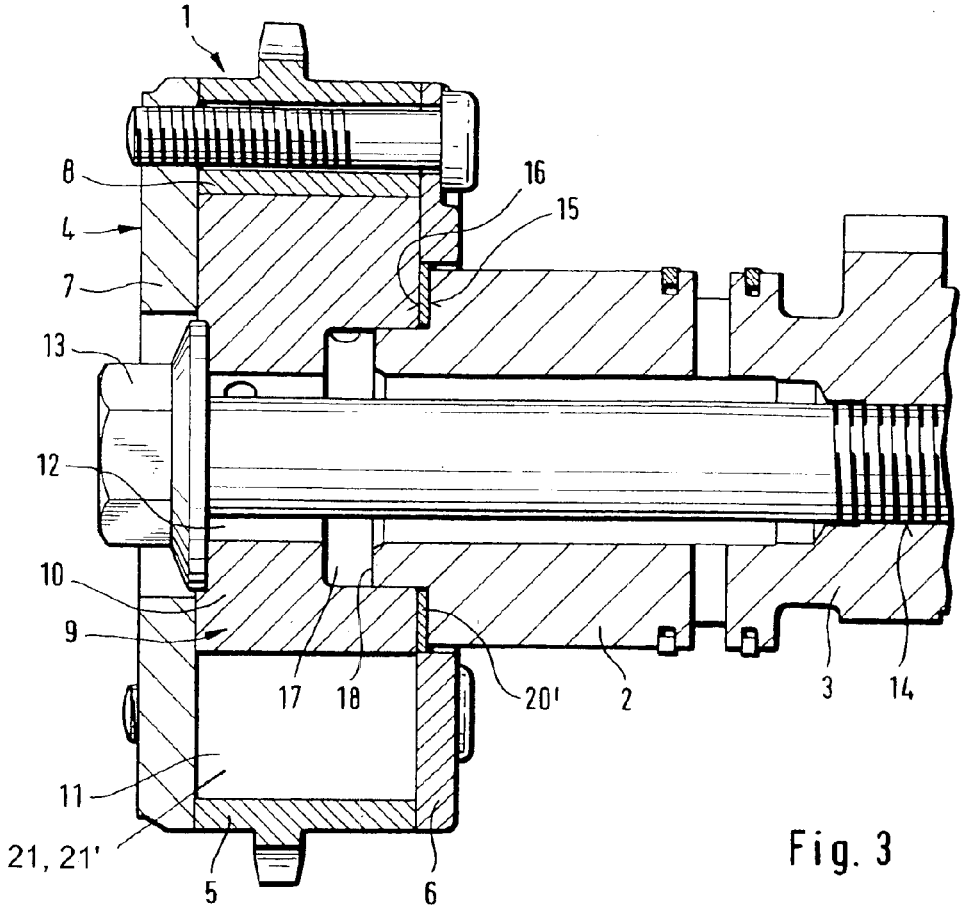
FIG. 3 shows a longitudinal section through a second embodiment of a device designed according to the invention.

FIGS. 1 and 3 each show embodiments of a device 1 for altering the control times of gas exchange valves of an internal combustion engine. It is of a type known as a blade unit adjuster, which varies the opening and closing times of gas exchange valves actuated by the camshaft by adjusting the rotation angle of a camshaft with respect to a crankshaft of an internal combustion engine. The device 1 is in principle a hydraulic actuating drive. It may be controlled as a function of various operating parameters of the internal combustion engine. It is arranged clearly visibly at the drive-side end 2 of a camshaft 3. The blade unit adjuster is mounted in the cylinder head (not shown) of an internal combustion engine. The adjuster substantially comprises a drive unit 4, which is drive-connected to a crankshaft (not shown) of the internal combustion engine, and an output unit 9, which is connected in a rotationally fixed manner to the camshaft 3 of the internal combustion engine. The drive unit 4 is comprised of a hollow gear, which comprises a hollow-cylindrical circumferential wall 5 and two axially separated side walls 6, 7. It has external toothing (not shown in detail) and a plurality of inner radial webs 8, between which a plurality of separate hydraulic working chambers are formed. By contrast, the output unit 9 comprises a blade wheel which is inserted into the hollow gear and has a plurality of blades 11 which extend radially away from its wheel hub 10 and divide the working chambers in the drive unit 4 into in each case two hydraulic pressure chambers 21, 21' (shown in FIG. 3) acting against one another.

Furthermore, FIGS. 1 and 3 show that the blade wheel, which forms the output unit 9, has an axial through-bore 12 in its wheel hub 10, which also is a pressure-medium passage. The side face 16 of the output unit which faces the camshaft is fixed, in both the axial and peripheral directions, in a nonpositively locking manner to the end side 15 of the drive-side end 2 of the camshaft 3 by the prestressing force of a central securing bolt 13. That bolt is guided through the through-bore 12 and may be screwed into an axial threaded bore 14 in the end side 15 of the camshaft 3. In addition, that side face 16 of the output unit 9 which faces (to the right) toward the camshaft and the cooperating end side 15 of the camshaft 3 each have a molded element which also fixes the device 1 unambiguously in the radial direction to the camshaft 3. There is a reduced diameter centering opening 17 in the axial through-bore 12 in the output unit 9 and a correspondingly reduced diameter centering pin 18 on the end side 15 of the camshaft 3 received in the opening 17. The hollow gear drive unit 4 of the device 1 is rotatably mounted, via its inner radial webs 8, on the wheel hub 10 of the output unit 9, which is designed as a blade wheel. They are connected in a force-transmitting manner, via the pressure chambers 21, 21' (FIG. 3) formed inside the device 1, such that when a hydraulic pressure medium is applied to the pressure chambers 21, 21' alternately or simultaneously, the output unit 9 undergoes relative rotation or is fixed with respect to the drive unit 4, which causes corresponding rotation or fixation of the camshaft 3 with respect to the crankshaft.

Furthermore, in FIGS. 1 and 3, to avoid an increased mechanical load on the output unit 9 from high prestressing force of the central securing bolt 13, according to the invention, an additional annular disk 20, 20', is arranged between that side face 16 of the output unit 9 which faces the camshaft and the end side 15 of the camshaft 3. On both of its side faces, the disk 20, 20' has a coating 19 which increases the frictional force between the output unit 9 and the camshaft 3. This enables affixation of the output unit 9 of the device 1 to the end side 15 of the camshaft 3 without play in the axial and peripheral directions and with a reduced prestressing force of the central securing bolt 13, while enabling the same torque forces to be transmitted from the drive unit 4 to the camshaft 3, whereby the mechanical load on the output unit 9 may be reduced. The reduced prestressing force on the central securing bolt 13 therefore makes the additional annular disk 20, 20' an indispensable component of the connection between the device 1 and the camshaft 3. To avoid assembly errors and resulting damage, the annular disk 20, 20' may have any of various mechanically or visually detectable elements for checking if it is present.

Figure 2:
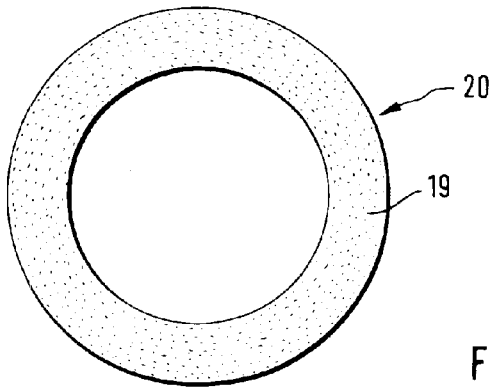
FIG. 2 shows an individual-part illustration of the additional annular disk in accordance with the first embodiment of the device designed according to the invention.

In the first embodiment of FIGS. 1 and 2, the additional annular disk 20, comprises a metal disk which is coated on both opposite side faces with aluminum-titanium dioxide. The disk is inserted like a standard washer into the clamping joint between the output unit 9 of the device 1 and the end side 15 of the device 3. As a check that this annular disk 20 is present, the disk has a defined thickness d, while a stop face 21 is arranged opposite the drive unit 4 of the device 1, at a distance a which is selected to be less than the thickness d of the annular disk 20, in the direction which faces the camshaft. The stop face is defined by a further engine component 22, which in FIG. 1 is a pressure-medium distributor of the device 1. When the device 1 is being bolted to the camshaft 3 by the central securing bolt 13, unintentional omission of the annular disk 20 may be mechanically detected when the device 1 becomes jammed against the stop face 21.

Figure 4A:
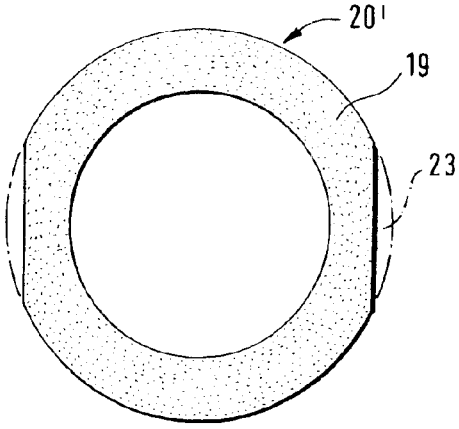
FIG. 4*a* shows an individual-part illustration of a first variant of the additional annular disk according to the second embodiment of the device which has been designed in accordance with the invention.
Figure 4B:
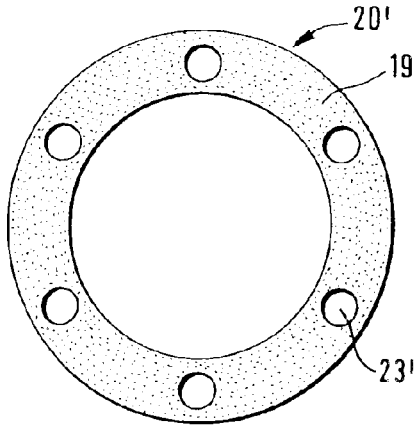
FIG. 4*b* shows an individual-part illustration of a second variant of the additional annular disk in accordance with the second embodiment of the device which has been designed according to the invention.

In the second embodiment of the device 1 in FIG. 3, an additional annular disk 20' in FIG. 4*a* or 4*b*, comprises a plastic film or metal foil with a coating 19 comprised of diamond dust disposed on both opposite side faces. To check if this annular disk 20' is present when the device 1 is being bolted to the camshaft 3, the annular disk 20' has various visually detectable features, which make it stand out from adjacent components or make it visually noticeable. In the first annular disk 20' variant in FIG. 4*a*, these exemplary visual features are a reflection layer mixed into the coating 19 and recesses 23 machined into the side faces shaped as parallel notches. In the second annular disk 20' variant FIG. 4*b*, the optical features are an indicator color, which is mixed into the coating 19, and a plurality of recesses 23', which are machined into the side faces in the form of stamped holes distributed uniformly around the circumference. Through the recesses 23', as for the recesses 23 in the first disk variant 20', the surface of that end side 15 of the camshaft 3 disposed below the annular disk 20' is visible.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A device for hydraulically adjusting a rotation angle of a camshaft with respect to a crankshaft of an internal combustion engine, the device comprising:

a camshaft mountable in a cylinder head of the internal combustion engine, the camshaft having a drive-side end positionable in the cylinder head, wherein the drive-side-end is shaped to define a hydraulic actuating drive controllable as a function of engine operating parameters;

the device further comprising:

a drive unit drivingly connected to a crankshaft of the engine;

an output unit separate from the drive unit, the output unit being connected rotationally fixed to the camshaft;

an axial through-bore in the output unit for defining a pressure medium passage;

a securing bolt through the through-bore and sized smaller than the through-bore for providing the pressure medium passage past the bolt in the bore;

an axially threaded bore in the camshaft toward an end side of the camshaft in which the securing bolt is screwed and held;

the output unit having a radially directed, axially, facing end face which faces toward the camshaft and the camshaft having an opposed radially directed, axially facing end side, wherein the end face of the output unit and the end side of the drive side end of the camshaft are non-positively lockable by a prestressing force applied to the output unit and the camshaft to move them together;

complementarly molded elements on the end face of the output unit facing the camshaft and the end side of the camshaft facing the output unit and shaped and cooperating for fixing the device to the camshaft in a positive locking manner in the radiall direction;

wherein the drive unit is rotatably mounted on the output unit and is connected there to define at least two hydraulic pressure chambers inside the device, the chambers acting against one another such that forces are transmitted via the at least two hydraulic pressure chambers, such that application of hydraulic pressure to the pressure chambers selectively either rotates the output unit or fixes the output unit with respect to the drive unit and correspondingly rotates or fixes the camshaft with respect to the crankshaft;

an annular disk having opposite side faces coated to increase frictional force, the disk being disposed between the side face of the output unit facing the camshaft and the end side of the camshaft and in engagement therewith, and the disk cooperating with the securing bolt for reducing the prestressing force of the bolt required for play-free torque transmission from the drive unit to the camshaft;

elements on the annular disk enabling detection of whether the disk is present in the device.

2. The device of claim 1, wherein the elements on the disk are detectable either mechanically or visually with the disk in position between the output unit and the camshaft.

3. The device of claim 2, wherein the annular disk is a metal disk of a first thickness and a detector at the device adapted for detecting the absence of the first thickness of the annular disk to check if the disk is present.

4. The disk of claim 3, further comprising the detector for the disk further comprising a stop face arranged opposite the drive unit in a direction facing the camshaft, such that when the device is attached to the camshaft by the securing bolt, absence of the disk and first thickness of thereof is mechanically detectable when the device becomes jammed against the stop face, and upon tightening of the bolt the presence of the disk preventing the device from becoming jammed against the stop face.

5. The device of claim 2, wherein the annular disk has a coating on its surfaces of aluminum-titanium dioxide.

6. The device of claim 5, wherein the annular disk is a metal disk coated with aluminum-titanium dioxide.

7. The device of claim 4, wherein the stop face comprises an engine component surrounding the camshaft and the stop face is spaced a distance from the drive unit that is less than the first thickness of the annular disk.

8. The device of claim 2, wherein the disk comprises a plastic film or metal foil and the opposite sides thereof are coated with a hard material.

9. The device of claim 8, wherein the coating material is diamond dust.

10. The device of claim 2, wherein the disk is shaped with features that are visible when the disk is placed in the device such that the presence of the disk is determined by visual inspection.

11. The device of claim 10, wherein the visible features are an indicative color or a reflection layer mixed in with the coating on the disk, or at least one local recess in or at the side faces of the disk, through which a surface covered by the disk is visible.

* * * * *